US005454400A

United States Patent [19]

Rodgers

[11] Patent Number: 5,454,400

[45] Date of Patent: Oct. 3, 1995

[54] ZERO LEAKAGE DIRECTIONAL CONTROL VALVE

[76] Inventor: Michael F. Rodgers, 7710-T Cherry Park #115, Houston, Tex. 77095

[21] Appl. No.: 132,688

[22] Filed: Oct. 6, 1993

Related U.S. Application Data

[63] Continuation of Ser. No. 913,248, Jul. 14, 1992, abandoned.

[51] Int. Cl.[6] ..... F15B 13/042

[52] U.S. Cl. ..... 137/596.18; 137/454.6; 137/596.1; 251/332; 251/900

[58] Field of Search ..... 137/596.18, 596.1, 137/625.27, 454.6; 251/332, 900

[56] References Cited

U.S. PATENT DOCUMENTS

| | | | |
|---|---|---|---|
| 1,373,599 | 4/1921 | Clark | 137/596.18 |
| 2,477,237 | 7/1949 | Carr | 137/596.1 |
| 2,535,785 | 12/1950 | Couri | 91/457 X |
| 2,658,523 | 11/1953 | Johnson | 137/625.27 X |
| 2,959,188 | 11/1960 | Kepner | 137/539 X |
| 3,272,218 | 9/1966 | Johnson | 251/332 X |
| 3,326,239 | 6/1967 | Saint-Joanis et al. | 137/625.27 X |
| 4,014,510 | 3/1977 | Smith | 251/332 X |
| 4,071,046 | 1/1978 | Cates | 137/596.15 |
| 4,304,258 | 12/1981 | Mitchell | 251/332 X |

*Primary Examiner*—Gerald A. Michalsky
*Attorney, Agent, or Firm*—Charles C. Garner

[57] ABSTRACT

A fluid directional control valve has at least one working fluid control port and a pressure inlet controlled with respect thereto by a poppet valve where zero leakage sealing is achieved by provision of a poppet seat which combines a resilient seal portion with a non-deformable poppet supporting portion; has a second, axially aligned valve, which may also be a poppet assembly, for controlling fluid exhaust flow from the controlled port and has an extended plunger whereby actuation of the second valve blocks exhaust flow while unseating the pressure control poppet.

28 Claims, 3 Drawing Sheets

ZERO LEAKAGE DIRECTIONAL CONTROL VALVE

This is a continuation of parent application Ser. No. 07/913,248 filed Jul. 14, 1992, now abandoned, which was not abandoned, at the filing of this continuation. This continuation claims benefits of earlier filing date of said parent application; is by the same inventor; and was filed prior to patenting, abandonment, or termination of proceedings on said parent application, in accordance with 35 USC 120.

FIELD OF THE INVENTION

The present invention relates to the field of fluid power control valves with more than two flow paths, and more particularly to such devices comprising an arrangement of poppet valves for actuator control using limited volume pressure sources where leakage is detrimental.

BACKGROUND AND SUMMARY OF THE INVENTION

Pipe-lines are routed through remote areas to transport their product to the market. Shut-off or "block" valves are located along the way, as needed for safety and rerouting efficiency and without particular regard to accessibility for operation and maintenance. While a block valve may be located at a convenient operating station, it is more likely not to be so placed. Pipe-lines are sized to permit the flow of massive volumes of product with minimal pressure losses and the block valves are consequently large, heavy assemblies which require power for opening and closing. Hydraulic or pneumatic driven actuators are preferred for reasons of simplicity and efficiency. Either a straight gas, or a gas over oil system is used with the operation controlled by a small four-way valve. With an appropriate pipe-line product and sufficient working pressure, the pipe-line itself can be the power source, but this is only possible when the product is a gas within acceptable contamination limits and environmentally tolerable. Fortunately, block valve operation is not a frequent event, so that high pressure nitrogen "bottles" placed on location as a power source can serve for an extended period with no attention other than scheduled inspections. Furthermore, bottled nitrogen is inexpensive and is readily available in all parts of the world.

The bottled gas pressure is in the 2,500 to 3,000 psi range when freshly charged, and obviously, with this limited volume available, a leak is a potential maintenance and reliability problem. As a general rule, leakage and internal clearances for reliable operation are necessary companions, so that all otherwise suitable four-way control valves have an inherent degree of leakage in the neutral mode. Therefore, it has been a common practice to place a two-way cut-off valve between the pressure supply and the four-way valve with both being pilot or solenoid operated for control at remote locations. The added costs, circuit complexity and maintenance are tolerated as necessary "trade-offs".

Metal-to-metal sealing of high pressure gases is routine using needle valves, where the valve seating force is simply increased until cut-off is achieved, but pilot and solenoid valve operators lack such capability. Some smaller sized pilot operated cut-off valves have enjoyed limited success using deformable poppets, made from nylon or a similar material, in conjunction with a metallic seat, but this arrangement is not suitable for use in the larger valves because of the scale effect. In time, the deformable material of the poppet takes a permanent set and behaves much like a metal-to-metal contact seal. Conventional resilient sealing elements such as "O" rings can be displaced by fluid flow or high pressure and are generally unreliable for such service. While it is recognized that "deformable" and "resilient" are somewhat ambiguous terms related to elasticity, in the context of this application, "deformable" infers an independent ability to maintain functional shape while "resilient" infers a shape dependent on external support. Kepner, in his U.S. Pat. Nos. 2,959,188 and 3,335,750, teaches a poppet type check valve seat/seal design wherein the seat combines metallic and resilient elements arranged to contact the poppet for reliable, non-leaking operation. These poppet valves, available from Kepner Products Co., Inc. in a pilot operated configuration as their "2700 Series", have been widely used as cutoff valves for block valve actuators since the late 1970's.

Others, notably Acar, U.S. Pat. No. 4,109,675; Boehringer, U.S. Pat. No. 4,172,469 and Nimberger, U. S. Pat. No. 4,655,251, have taught poppet check valve designs using a combination of metallic and resilient seat elements for non-leaking operation.

Still others, for example Pick, U. S. Pat. No. 2,240,163, have taught the use of poppet valves in four-way configurations with either deformable poppets or poppet seals working against metallic seats, and such devices continue to be the common commercial practice. A poppet type control valve can have greater tolerance for unfiltered grit in the operating medium than an equivalent spool type valve and, all things being equal, is preferred for reliability in critical applications.

The object of the present invention is therefore, to provide a poppet type directional control valve for reliable, non-leaking gas operation in pipeline service and other critical applications, and thus, to eliminate the need for an auxiliary cut-off valve and the attendant cost, circuit complexity and maintenance requirements involved.

The present invention accomplishes this objective by incorporating a combination metallic and resilient multiple part seat in a poppet type four-way control valve which thereby differs from conventional metallic seat practice. Such seats have been known for many years and poppet unseating pilot plungers are well known in pilot operated relief and check valve design. The inventor has first recognized that assembly of the metallic/resilient seat in a valve body cam be facilitated by the use of a separate unseating pilot plunger, while the pilot plunger can also include the exhaust valve means required for a directional control function, so as to provide the long needed non-leaking directional control valve.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
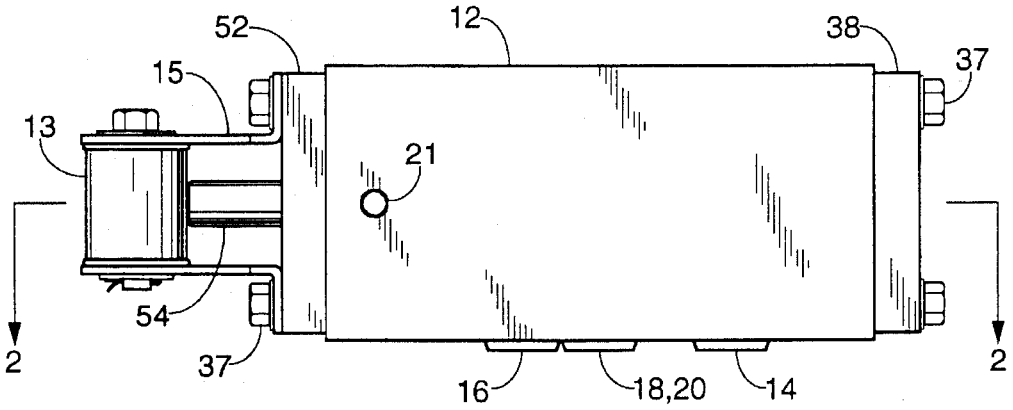
FIG. 1. shows a side view of a directional control valve incorporating the present invention.
Figure 2:
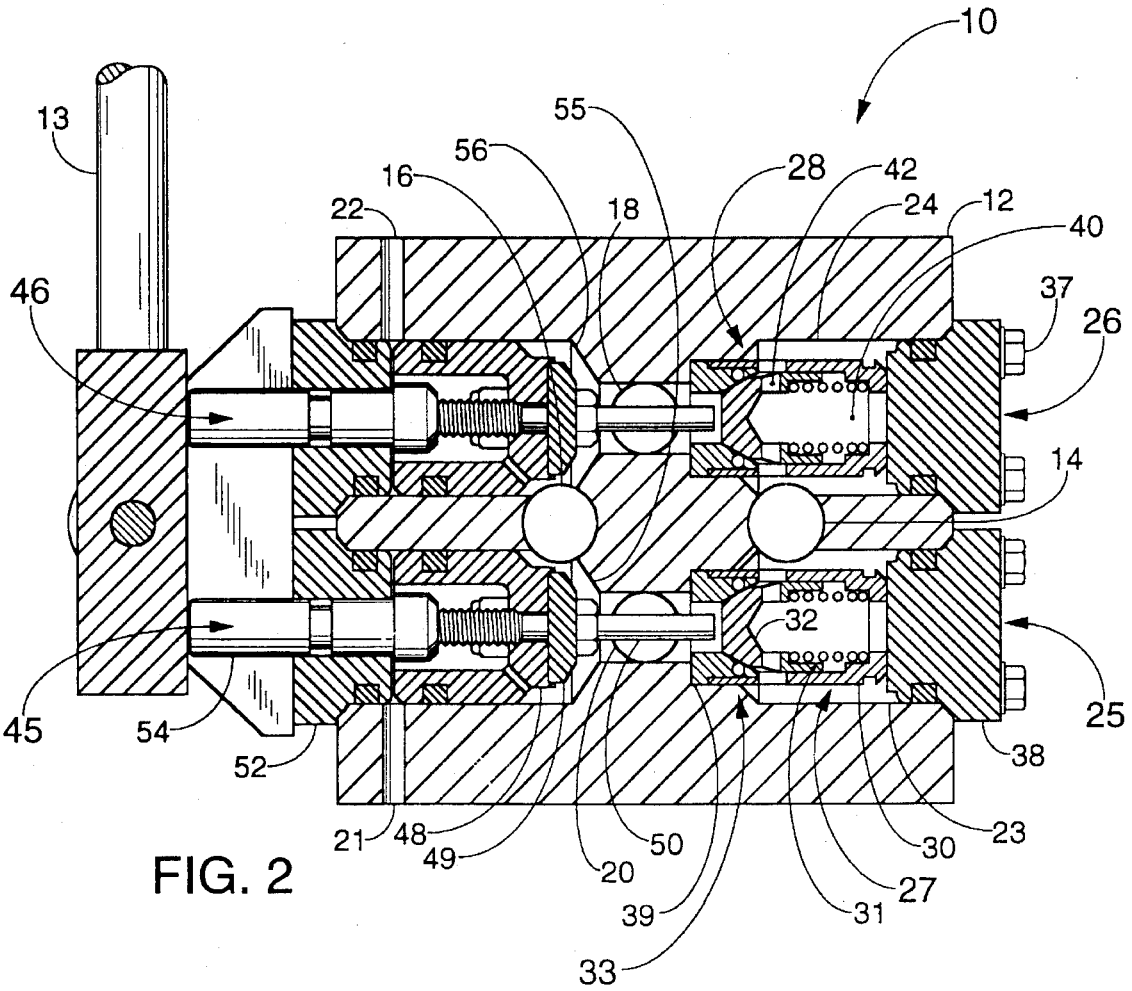
FIG. 2. shows a cross-sectional view of the preferred embodiment of the invention as in the neutral control position.
Figure 2A:
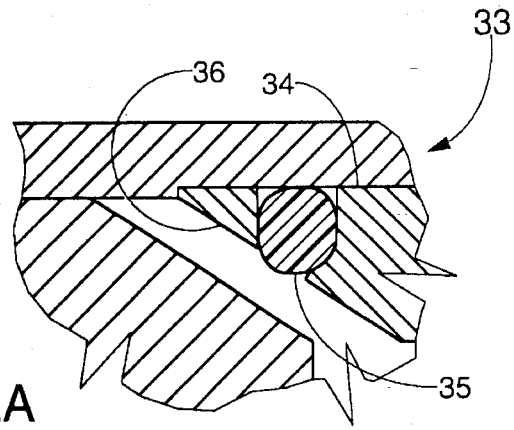
FIG. 2*a* is an enlarged view of the poppet seat assembly of FIG. 2.
Figure 3:
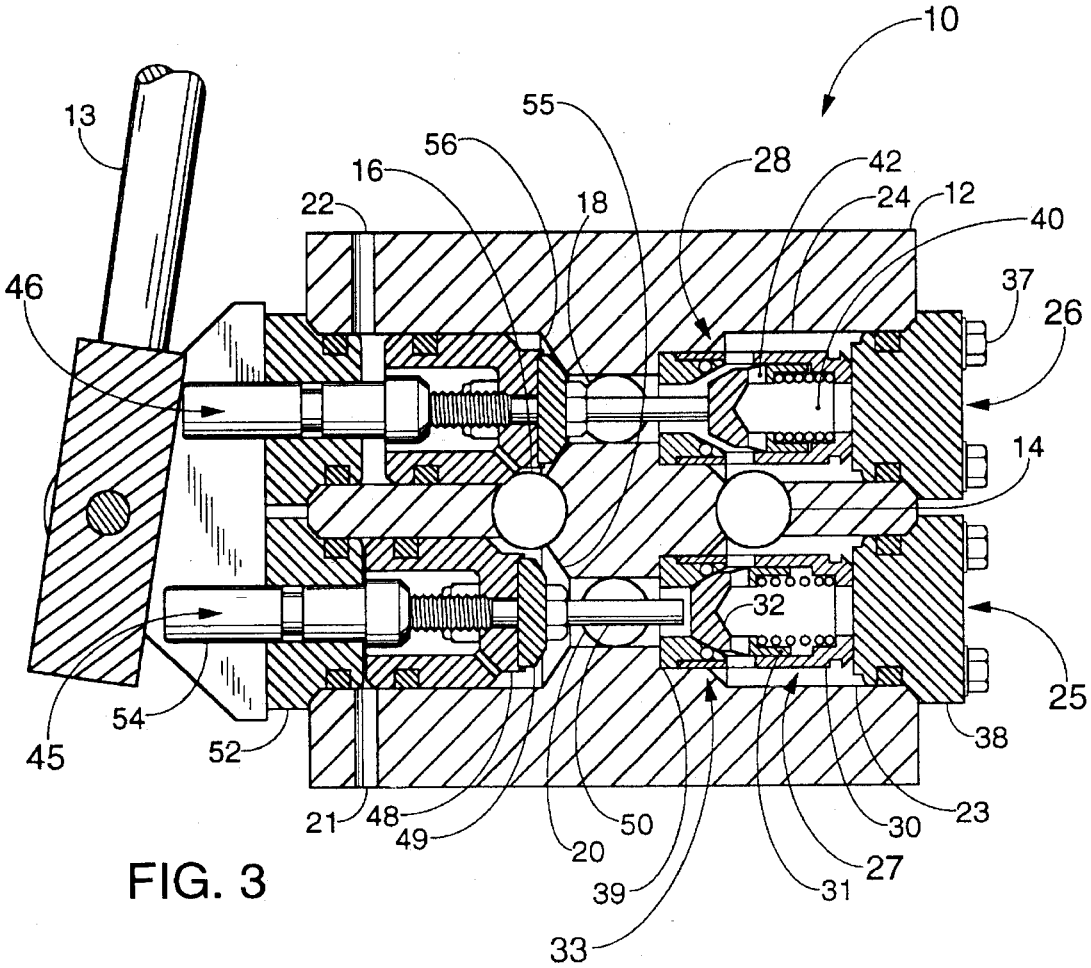
FIG. 3. shows a cross-sectional view of the preferred embodiment of the invention as in a control position.
Figure 4:
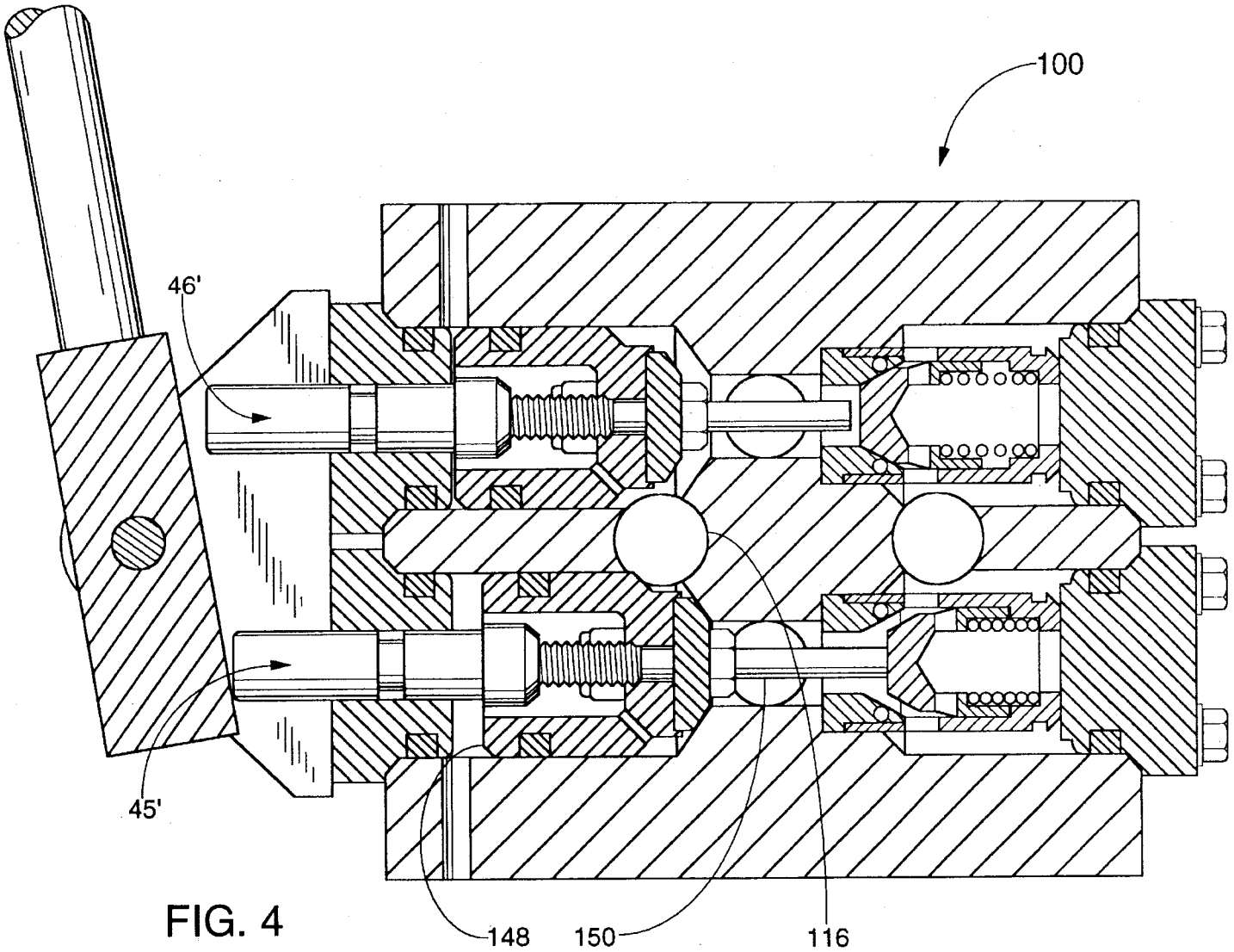
FIG. 4. shows a cross-sectional view of the preferred embodiment of the invention as in the opposite control position.

In FIG. 1 is shown an end view of the external assembly of a preferred embodiment 10 of a four-way, three position valve utilizing the present invention. Valve body 12 is seen to have sealing end caps 38 and operating end caps 52. Manual operating lever 13, shown in the passive, or "neutral" position, is pivotally mounted on brackets 15 to displace manual operating plungers 54. Also shown are pilot operating port 21, fluid pressure inlet port 14, fluid exhaust port 16 and working fluid control ports 18 and 20. Section arrows 2—2 indicate the basis and orientation for FIG. 2. Turning to FIG. 2, there is shown the cross-section 2—2 of preferred embodiment 10 in the neutral position. The locations of fluid pressure inlet port 14, fluid exhaust port 16, and the working fluid control ports 18 and 20 in valve body 12 are shown. Fluid pressure inlet port 14 is connected to an unshown fluid pressure source, understood to comprise a liquid or gaseous working medium. Also shown in valve body 12 are the pilot operating ports 21 and 22 and machined cavities 23 and 24 for identical valve assemblies 25 and 26 which operate cooperatively in this four-way application of the invention. Pressure sealing cartridge valve sub-assemblies 27 and 28, each comprise a round, tubular jacket 30 with seating spring 31 and frusto-conical poppet 32 fitted for free axial movement. Frusto-conical metallic poppet 32 fits against seat assembly 33, made up of conical surface matching metallic support member 34, resilient seal member 35, which may be made of Teflon or a similar impermeable material, and rigid seal retaining member 36. Seat assembly 33 is shown in enlarged detail in FIG. 2A. It can be seen that pressure at fluid pressure inlet port 14 will urge poppet 32 against the matching surface of support member 34 and also urge resilient sealing member 35 into intimate, positively sealed contact with both parts. Cartridge assemblies 27 and 28 are clamped in place by sealed end caps 38 and bolts 37, and downstream leakage is prevented by static seal 39. FIG. 2 shows backside spring chamber 40 located behind poppet 32, and poppet backside ventholes 42 located in poppet 32, wherein pressure in chamber 40 is vented to inlet fluid pressure port 14; and the same items are also shown in FIGS. 3 and 4. Axially aligned with cartridge assemblies 27 and 28, at the opposite ends of machined cavities 23 and 24, are exhaust sealing valve sub-assemblies 45 and 46, and each comprises a sealed piston poppet 48 and conical seal 49. Free fluid flow is permitted from both working fluid ports 18 and 20. From the location of poppet backside ventholes 42 in poppet 32 as shown in FIGS. 2, 3, and 4, it will be obvious that the pressure in backside spring chamber 40 will be vented via said ventholes 42 to inlet fluid pressure port 14, permitting poppet 32 to be unseated by extension of plunger extension 50. Plunger extension 50 retains conical seal to poppet 48 and extends toward opposed poppet 32. Machined cavities 23 and 24 are sealed at this end by operating end caps 52, each provided with a manual operating plunger 54.

It should be noted that in the embodiment 100 of FIG. 4, otherwise unchanged from the preferred embodiment 10, fluid exhaust port 116 is displaced slightly so that piston spool 148 acts to block fluid exhaust flow but a longer stroke is required and thus also, a shorter plunger extension 150. It is thus understood that exhaust sealing valve sub-assemblies 45 and 46, previously shown in poppet form, are fully capable of expression as alternate sub-assemblies 45' and 46' in other form. As is shown in FIGS. 3 and 4, piston poppet 48 can be offset either by manual operating plunger 54 or by pilot pressure to appropriate pilot operating port 21 or 22. Fluid exhaust port 16 normally communicates for flow from both working fluid control ports 18 and 20, but, when piston poppet 48 is offset, conical seal 49 is pressed against mating conical surface 55 or 56 to block that flow. Furthermore, the initial movement of piston poppet 48 brings plunger extension 50 into contact with pressure sealing frusto-conical poppet 32 and additional movement unseats poppet 32, admitting pressurized fluid to the related fluid control port 18 or 20. When this flow is directed to an actuating function, flow from the actuator returns through the alternate port 18 or 20 so as to complete the control loop.

Those skilled in the art will readily appreciate that valve assembly 26 taken by itself in valve body 12, taken in conjunction with fluid pressure inlet port 14, fluid exhaust port 16 and working fluid control port 20, comprises a complete and operational three-way directional control valve.

It is to be understood that the present invention is not limited to the disclosed embodiments, but is fully capable of rearrangement, modification and substitution of parts within the spirit of the invention.

I claim:

1. A four-way, three position fluid control valve which prevents pressure leakage in the neutral position comprising:

a valve body including a fluid pressure inlet port, a fluid exhaust port and first and second working fluid control ports;

a fluid pressure source communicating to said fluid pressure inlet port;

first and second valve means for communicating said first and second working fluid control ports selectively and alternatively with said fluid pressure port and said fluid exhaust port, each said valve means having axially aligned first and second sealing means for opening and closing communication with said pressure port and said exhaust port respectively;

said first sealing means comprising a replaceable cartridge valve assembly;

said replaceable cartridge valve assembly comprising a non-deforming poppet and seat for contact therewith wherein the contacting seat portion has a non-deforming support portion, a resilient seal portion made of impermeable material, and a seal retaining portion so that said fluid pressure source urges said poppet to contact said supporting portion, and is sealed without leakage by said impermeable resilient seal portion; and said second sealing means including pilot means for operating its respective said valve means and extended pilot plunger means for contacting and unseating said non-deforming poppet.

2. A four-way, three position fluid control valve which prevents pressure leakage in the neutral position according to claim 1 wherein:

the non-deforming poppet of said first sealing means is frusto-conical in shape; and the supporting seat portion in contact therewith provides a matching conical surface.

3. A four-way, three position fluid control valve which prevents pressure leakage in the neutral position according to claim 1 wherein said second sealing means comprises a poppet valve.

4. A fluid control valve according to claim 1 wherein said axially aligned first and second sealing means are not rigidly connected to each other and have free space between them to permit independent movement axially.

5. A four-way three position fluid control valve which prevents pressure leakage in the neutral position comprising:

a valve body including a fluid pressure inlet port, a fluid exhaust port and first and second working fluid control ports;

a fluid pressure source communicating to said fluid pressure inlet port;

first and second valve means for communicating said first and second working fluid control ports selectively and alternatively with said fluid pressure port and said fluid exhaust port, each said valve means having axially aligned first and second sealing means for opening and closing communication with said pressure port and said exhaust port respectively;

said first sealing means comprising a replaceable cartridge valve assembly;

said replaceable cartridge valve assembly comprising a non-deforming poppet and seat for contact therewith wherein the contracting seat portion has a non-deforming support portion, a resilient seal portion made of impermeable material, and a seal retaining portion so that said fluid pressure source urges said poppet to contact said supporting portion and is sealed without leakage by said impermeable resilient seal portion; and said second sealing means including manual means for operating its respective said valve means and extended pilot plunger means for contacting and unseating said non-deforming poppet.

6. A four-way, three position fluid control valve which prevents pressure leakage in the neutral position according to claim 5 wherein:

the non-deforming poppet of said first sealing means is frusto-conical in shape; and the supporting seat portion in contact therewith provides a matching conical surface.

7. A four-way, three position fluid control valve which prevents pressure leakage in the neutral position according to claim 5 wherein said second sealing means comprises a poppet valve.

8. A fluid control valve according to claim 5 wherein said axially aligned first and second sealing means are not rigidly connected to each other and have free space between them to permit independent movement axially.

9. A three-way, two position fluid control valve which prevents pressure leakage in the neutral position comprising:

a valve body including a fluid pressure inlet port, a fluid exhaust port and a working fluid control port;

a fluid pressure source communicating to said fluid pressure inlet port;

valve means for communicating said working fluid control port selectively with said fluid pressure port or said fluid exhaust port, said valve means having axially aligned first and second sealing means for opening and closing communication with said pressure port and said exhaust port respectively;

said first sealing means comprising a replaceable cartridge valve assembly;

said replaceable cartridge valve assembly comprising a non-deforming poppet and seat for contact therewith wherein the contacting seat portion has a non-deforming support portion, a resilient seal portion made of impermeable material, and a seal retaining portion so that said fluid pressure source urges said poppet to contact said supporting portion, and is sealed without leakage by said impermeable resilient portion; and said second sealing means including pilot means for operating said valve means and extended pilot plunger means for contacting and unseating said poppet.

10. A three-way, two position fluid control valve which prevents pressure leakage in the neutral position according to claim 9 wherein:

the non-deforming poppet of said first sealing means is frusto-conical in shape; and the supporting seat portion in contact therewith provides a matching conical surface.

11. A three-way, two position fluid control valve which prevents pressure leakage in the neutral position according to claim 9 wherein said second sealing means comprises a poppet valve.

12. A fluid control valve according to claim 9 wherein said axially aligned first and second sealing means are not rigidly connected to each other and have free space between them to permit independent movement axially.

13. A three-way, two position fluid control valve which prevents pressure leakage in the neutral position comprising:

a valve body including a fluid pressure inlet port, a fluid exhaust port and a working fluid control port;

a fluid pressure source communicating to said fluid pressure inlet port;

valve means for communicating said working fluid control port selectively with said fluid pressure port or said fluid exhaust port, said valve means having axially aligned first and second sealing means for opening and closing communication with said pressure port and said exhaust port respectively;

said first sealing means comprising a replaceable cartridge valve assembly;

said replaceable cartridge valve assembly comprising a non-deforming poppet and seat for contact therewith wherein the contacting seat portion has a non-deforming support portion, a resilient seal portion made of impermeable material, and a seal retaining portion so that said fluid pressure source urges said poppet to contact said supporting portion, and is sealed without leakage by said impermeable resilient seal portion; and said second sealing means including manual means for operating said valve means and extended pilot plunger means for contacting and unseating said poppet.

14. A three-way, two position fluid control valve which prevents pressure leakage in the neutral position according to claim 8 wherein:

the non-deforming poppet of said first sealing means is frusto-conical in shape; and the supporting seat portion in contact therewith provides a matching conical surface.

15. A three-way, two position fluid control valve which prevents pressure leakage in the neutral position according to claim 13 wherein said second sealing means comprises a poppet valve.

16. A fluid control valve according to claim 13 wherein said axially aligned first and second sealing means are not rigidly connected to each other and have free space between them to permit independent movement axially.

17. A four-way, three position fluid control valve which prevents pressure leakage in the neutral position comprising:

a valve body including a fluid pressure inlet port, a fluid exhaust port and first and second working fluid control ports;

a fluid pressure source communicating to said fluid pressure inlet port;

first and second valve means for communicating said first and second working fluid control ports selectively and alternatively with said fluid pressure port and said fluid exhaust port, each said valve means having axially aligned first and second sealing means for opening and closing communication with said pressure port and said exhaust port respectively;

said first sealing means including a non-deforming poppet and seat for contact therewith wherein the contacting seat portion has a non-deforming support portion, a resilient seal portion made of impermeable material, and a seal retaining portion so that said fluid pressure source urges said poppet to contact said supporting portion, and is sealed without leakage by said impermeable resilient seal portion;

said first sealing means further comprising a spring chamber behind said poppet, said spring chamber vented to said fluid pressure inlet port and sealed from communicating with said exhaust port; and said second sealing means including means for operating its respective said valve means.

18. A four-way, three position fluid control valve which prevents pressure leakage in the neutral position according to claim 17 wherein said valve operating means comprises pilot pressure means.

19. A four-way, three position fluid control valve which prevents pressure leakage in the neutral position according to claim 17 wherein said valve operating means comprises manual means.

20. A four-way, three position fluid control valve which prevents pressure leakage in the neutral position according to claim 17 wherein the poppet of said first sealing means is frusto-conical, in shape; and the seat portion in contact therewith provides a matching conical surface.

21. A four-way, three position fluid control valve which prevents pressure leakage in the neutral position according to claim 17 wherein said second sealing means comprises a poppet valve.

22. A four-way, three position fluid control valve which prevents pressure leakage in the neutral position comprising:

a valve body including a fluid pressure inlet port, a fluid exhaust port and first and second working fluid control ports;

a fluid pressure source communicating to said fluid pressure inlet port;

first and second valve means for communicating said first and second working fluid control ports selectively and alternatively with said fluid pressure port and said fluid exhaust port, each said valve means having axially aligned first and second sealing means for opening and closing communication with said pressure port and said exhaust port respectively;

said first sealing means comprising a replaceable cartridge valve assembly;

said replaceable cartridge valve assembly comprising a non-deforming poppet and seat means for contact with said poppet wherein said contacting seat means has a non-deforming support portion, a resilient seal portion, and a seal retaining portion so that said fluid pressure source urges said poppet to contact said support portion, and is sealed without leakage by said resilient seal portion; and said second sealing means including means for operating its respective said valve means.

23. A three-way, two position fluid control valve which prevents pressure leakage in the neutral position comprising:

a valve body including a fluid pressure inlet port, a fluid exhaust port and a working fluid control port;

a fluid pressure source communicating to said fluid pressure inlet port;

valve means for communicating said working fluid control port selectively with said fluid pressure port or said fluid exhaust port, said valve means having axially aligned first and second sealing means for opening and closing communication with said pressure port and said exhaust port respectively;

said first sealing means including a non-deforming poppet and seat for contact therewith wherein the contacting seat portion has a non-deforming support portion, a resilient seal portion made of impermeable material, and a seal retaining portion so that said fluid pressure source urges said poppet to contact said supporting portion, and is sealed without leakage by said impermeable resilient portion;

said first sealing means further comprising a spring chamber behind said poppet, said spring chamber vented to said fluid pressure inlet port and sealed from communicating with said exhaust port; and said second sealing means including means for operating said valve means.

24. A three-way, two position fluid control valve which prevents pressure leakage in the neutral position according to claim 23 wherein said valve operating means comprises pilot pressure means.

25. A three-way, two position fluid control valve which prevents pressure leakage in the neutral position according to claim 23 wherein said valve operating means comprises manual means.

26. A three-way, two position fluid control valve which prevents pressure leakage in the neutral position according to claim 23 wherein the poppet of said first sealing means is frusto-conical in shape; and the seat portion in contact therewith provides a matching conical surface.

27. A three-way, two position fluid control valve which prevents pressure leakage in the neutral position according to claim 23 wherein said second sealing means comprises a poppet valve.

28. A three-way, two position fluid control valve which prevents pressure leakage in the neutral position comprising:

a valve body including a fluid pressure inlet port, a fluid exhaust port and a working fluid control port;

a fluid pressure source communicating to said fluid pressure inlet port;

valve means for communicating said working fluid control port selectively with said fluid pressure port or said fluid exhaust port, said valve means having axially aligned first and second sealing means for opening and closing communication with said pressure port and said exhaust port respectively;

said first sealing means comprising a replaceable cartridge valve assembly;

said replaceable cartridge valve assembly comprising a non-deforming poppet and seat means for contact with said poppet wherein said contacting seat means has a non-deforming support portion, a resilient seal portion, and a seal retaining portion so that said fluid pressure source urges said poppet to contact said support portion, and is sealed without leakage by said resilient seal portion; and said second sealing means including means for operating said valve means.

* * * * *